US010270196B2

(12) United States Patent
Wang et al.

(10) Patent No.: US 10,270,196 B2
(45) Date of Patent: Apr. 23, 2019

(54) HIGH CURRENT CONNECTOR AND SOCKET CONNECTOR THEREOF

(71) Applicant: Kingfont Precision Industrial Co., Ltd., New Taipei (TW)

(72) Inventors: Tsung-Hai Wang, New Taipei (TW); Tien-Chiao Cheng, New Taipei (TW)

(73) Assignee: KINGFONT PRECISION INDUSTRIAL CO., LTD., New Taipei (TW)

( * ) Notice: Subject to any disclaimer, the term of this patent is extended or adjusted under 35 U.S.C. 154(b) by 0 days.

(21) Appl. No.: 15/668,596

(22) Filed: Aug. 3, 2017

(65) Prior Publication Data

US 2018/0076552 A1 Mar. 15, 2018

(30) Foreign Application Priority Data

Sep. 9, 2016 (TW) ..... 105129364 A

(51) Int. Cl.
*H01R 9/24* (2006.01)
*H01R 13/11* (2006.01)
(Continued)

(52) U.S. Cl.
CPC ..... *H01R 13/111* (2013.01); *H01R 13/04* (2013.01); *H01R 13/187* (2013.01); *H01R 24/20* (2013.01); *H01R 24/28* (2013.01); *H01R 2101/00* (2013.01)

(58) Field of Classification Search
CPC .... H01R 13/04; H01R 13/111; H01R 13/187; H01R 24/20; H01R 24/28; H01R 2101/00
(Continued)

(56) References Cited

U.S. PATENT DOCUMENTS 3,970,355 A 7/1976 Pitschi
7,837,476 B2 * 11/2010 Di Stefano ..... H01R 4/027 439/66
(Continued)

FOREIGN PATENT DOCUMENTS

CN 102738627 A 10/2012
CN 102754281 A 12/2012
(Continued)

OTHER PUBLICATIONS

Office Action dated Nov. 2, 2018 of the corresponding China Patent Application No. 201710656679.3.

*Primary Examiner* — Khiem M Nguyen
(74) *Attorney, Agent, or Firm* — Chun-Ming Shih; HDLS IPR Services

(57) ABSTRACT

A high current connector and a socket connector of the high current connector are provided. The high current connector includes a first connector, a resilient electrical conductor and a second connector. The first connector includes an insertion slot. The resilient electrical conductor is received in the insertion slot and includes a resilient body, an insertion space formed inside the resilient body, and gaps arranged annularly on the resilient body. The second connector includes a conductive element inserted in the insertion space, the conductive element is electrically connected to the first connector through the resilient electrical conductor and is fixed in the insertion slot by means of stretchable configuration of the gaps. Accordingly, the resilient electrical conductor tightly fixes the conductive element to achieve reliable and safe connection and also improve contact quality.

12 Claims, 10 Drawing Sheets

(51) Int. Cl.

| | |
|---|---|
| ***H01R 24/20*** | (2011.01) |
| ***H01R 13/04*** | (2006.01) |
| ***H01R 13/187*** | (2006.01) |
| *H01R 24/28* | (2011.01) |
| *H01R 101/00* | (2006.01) |

(58) Field of Classification Search
USPC ..... 439/840–843, 889
See application file for complete search history.

(56) References Cited

U.S. PATENT DOCUMENTS

| | | | | |
|---|---|---|---|---|
| 8,378,218 | B2 * | 2/2013 | Dicken | H01R 13/2421 174/126.1 |
| 8,753,153 | B2 * | 6/2014 | Leon | B21F 1/00 439/840 |
| 8,876,562 | B2 * | 11/2014 | Glick | H01R 13/187 439/843 |
| 9,325,095 | B2 * | 4/2016 | Glick | H01R 13/187 |

FOREIGN PATENT DOCUMENTS

| | | | |
|---|---|---|---|
| CN | 103597668 | A | 2/2014 |
| CN | 103907243 | A | 7/2014 |
| CN | 103915702 | A | 7/2014 |
| CN | 102754281 | B | 9/2014 |
| CN | 203859303 | A | 10/2014 |
| CN | 104538767 | A | 4/2015 |
| CN | 104540545 | A | 4/2015 |
| CN | 207199960 | U | 4/2018 |

* cited by examiner

HIGH CURRENT CONNECTOR AND SOCKET CONNECTOR THEREOF

TECHNICAL FIELD

The present invention relates to a connector and, in particular, to a high current connector and a socket connector thereof, which achieves fastening by means of elasticity of a resilient electrical conductor.

BACKGROUND

When a connector is used for transmitting high electric current, safety is a priority concern and is a key point for evaluating quality of the connector. In order to establish electrical connection rapidly, screws are not used, and instead the connection is established by plugging in.

A high current connector, for transmitting a high electric current of 100 to 400 amperes for example or higher, can be used in electric cars, oil and electricity hybrid cars, or other equipment requiring high current. The conventional high current connector includes, for example, a housing and a contact blade serving as a plug connector to be inserted and disposed inside the housing. The housing and the contact blade consist of a conductive material and are connected with a cable for transmitting current.

The high current connector is required to have a small size while establishing reliable electrical contact between the housing and the plug connector. Moreover, even under shaking or vibrations of a machine, the electric current should still be transmitted well without causing abrasion or wear out of contact points.

However, so far, no high current connectors have properly met the above-mentioned requirement. In views of this, in order to solve the above problem, the present inventor studied related technology and provided a reasonable and effective solution in the present disclosure.

SUMMARY

It is an objective of the present invention to provide a high current connector and a socket connector thereof whereby a conductive element is tightly fastened by a resilient electrical conductor to provide safe, reliable, and improved connection and contact quality.

Accordingly, the present invention provides a high current connector including a first connector, a resilient electrical conductor and a second connector. The first connector includes an insertion slot. The resilient electrical conductor is accommodated in the insertion slot. The resilient electrical conductor includes a resilient body, an insertion space formed inside the resilient body, and a plurality of gaps formed on the resilient body. The second connector includes a conductive element inserted in the insertion space. The conductive element is electrically connected to the first connector through the resilient electrical conductor and is fixed in the insertion slot by means of stretchable configuration of the gaps.

According to one embodiment, the resilient body includes an outer circumferential surface, an inner circumferential surface opposite to the outer circumferential surface, and an axis coaxial with the outer circumferential surface and the inner circumferential surface.

According to one embodiment, the outer circumferential surface or the inner circumferential surface is inclined with respect to the axis.

According to one embodiment, each gap penetrates the outer circumferential surface and the inner circumferential surface, and the gaps are connected to form a spiral.

According to one embodiment, the outer circumferential surface is in contact with a wall surface of the insertion slot, and the inner circumferential surface is in contact with a surface of the conductive element.

According to one embodiment, the insertion slot is of conical shape, and the resilient electrical conductor is of conical shape corresponding to the cone-shaped insertion slot.

According to one embodiment, the insertion space is of cylindrical shape, and the conductive element is of cylindrical shape corresponding to the cylinder-shaped insertion space.

According to one embodiment, the insertion slot is of cylindrical shape, and the resilient electrical conductor is of cylindrical shape corresponding to the cylinder-shaped insertion slot.

According to one embodiment, the insertion space is of conical shape, and the conductive element is of conical shape corresponding to the cone-shaped insertion space.

According to one embodiment, the resilient electrical conductor further includes a closed end at one end of the resilient body and an engagement portion on an outer edge of the other end of the resilient body opposite to the closed end.

According to one embodiment, the first connector includes a recess corresponding to the engagement portion, so that the resilient electrical conductor is positioned in the insertion slot.

According to one embodiment, the resilient electrical conductor is a cylinder-shaped spiral spring or a cone-shaped spiral spring.

According to one embodiment, the resilient electrical conductor includes a contact portion between each two adjacent gaps.

According to one embodiment, a thickness of each contact portion gradually increases or decreases toward a bottom of the insertion slot.

According to one embodiment, a cross section of each contact portion is in a rectangular shape or in a circular shape.

The present invention further provides a socket connector including an insertion slot and a resilient electrical conductor. The resilient electrical conductor is accommodated in the insertion slot, the resilient electrical conductor includes a resilient body, an insertion space inside the resilient body, and an axis of the insertion slot coaxial with the insertion space, wherein the resilient body includes an outer circumferential surface and an inner circumferential surface opposite to the outer circumferential surface, the outer circumferential surface or the inner circumferential surface is inclined with respect to the axis.

The present invention further has the following advantages. The present invention utilizes the resilient electrical conductor having the spiral. Due to elastic stretching and shape matching of the resilient electrical conductor, the outer circumferential surface and the inner circumferential surface respectively closely contact the insertion slot of the first connector and the conductive element of the second connector to achieve safe and reliable connection.

The resilient electrical conductor of the present invention has a stable structure with a low tolerance, provides a large contact area and can be manufactured easily. If the connector has abrasion or is worn out, safe connection between the first connector and the second connector can still be ensured.

Furthermore, the resilient electrical conductor can prevent shifting or deviation and ensure a correct insertion angle to thereby avoid poor electrical contact.

BRIEF DESCRIPTION OF THE DRAWINGS

The disclosure will become more fully understood from the detailed description, and the drawings given herein below is for illustration only, and thus does not limit the disclosure, wherein.

DETAILED DESCRIPTION

Figure 1:
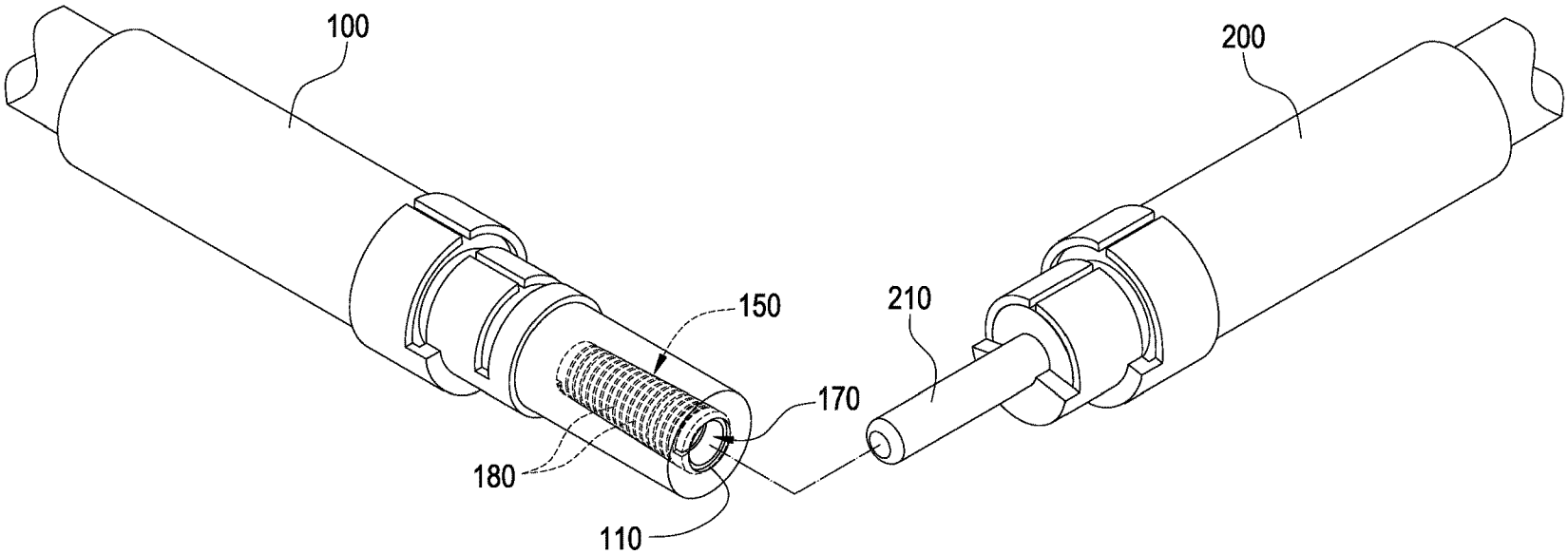
FIG. 1 is a perspective view showing a high current connector of the present invention.

Detailed descriptions and technical contents of the present invention are illustrated below in conjunction with the accompany drawings. However, it is to be understood that the descriptions and the accompany drawings disclosed herein are merely illustrative and exemplary and not intended to limit the scope of the present invention.

Referring to FIGS. 1 to 4, the present invention provides a high current connector which includes a first connector 100, a resilient electrical conductor 150 and a second connector 200. According to the first embodiment shown in the drawings, each of the first connector 100 and the second connector 200 is preferably a pillar-shaped connector electrically connected to a cable (not illustrated). By means of connection between the first connector 100 and the second connector 200, current of 100 to 400 amperes or higher can be transmitted. However, the present invention is not limited to the particular type or exterior design of the first connector 100 and the second connector 200 in this embodiment.

The first connector 100 is, for example, a socket connector. The first connector 100 includes an insertion slot 110. The resilient electrical conductor 150 is accommodated in the insertion slot 110. The resilient electrical conductor 150 includes a resilient body 160, an insertion space 170 formed inside the resilient body 160, and a plurality of gaps 180 formed on the resilient body 160. The second connector 200 is, for example, a plug connector. The second connector 200 includes a conductive element 210 inserted in the insertion space 170. The conductive element 210 is electrically connected to the first connector 100 through the resilient electrical conductor 150 and is fixed in the insertion slot 110 by the stretchable configuration of the gaps 180.

Figure 2:
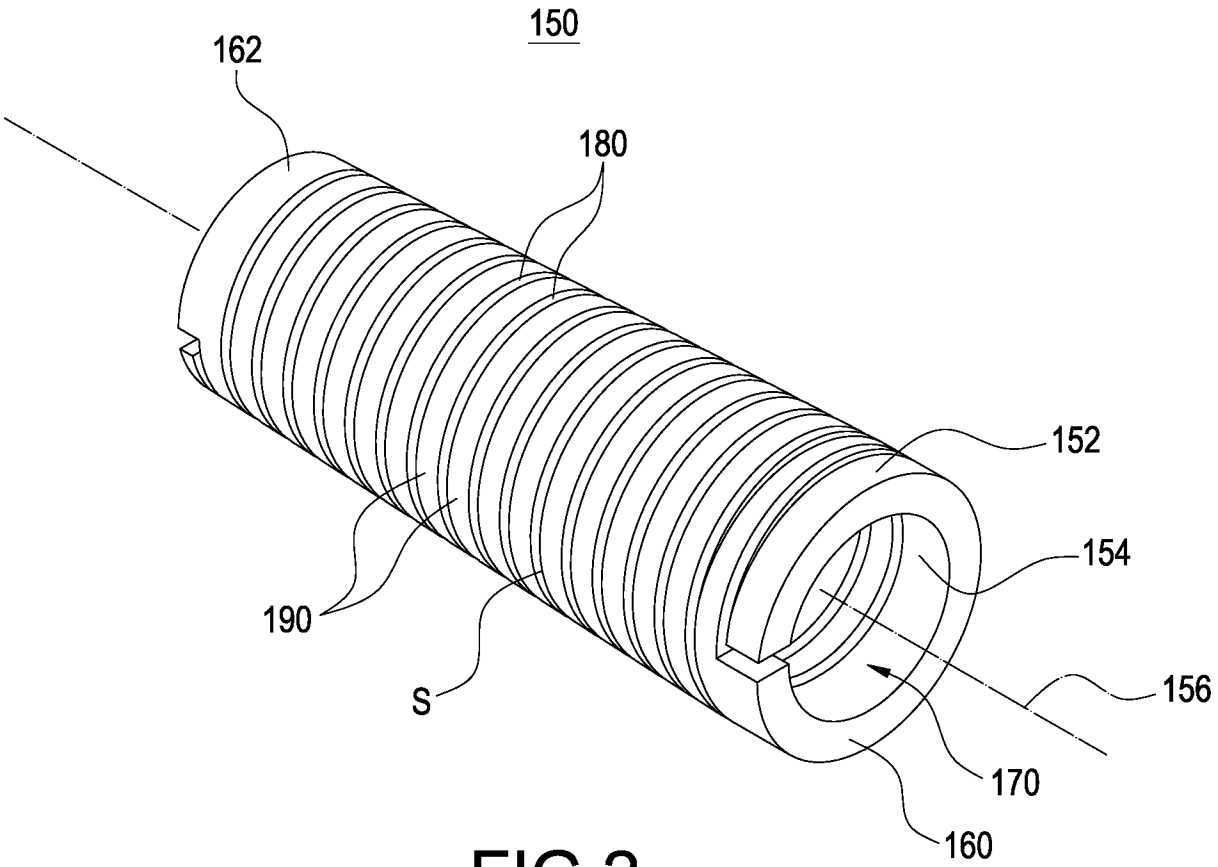
FIG. 2 is a perspective view showing a resilient electrical conductor according to the present invention.
Figure 3:
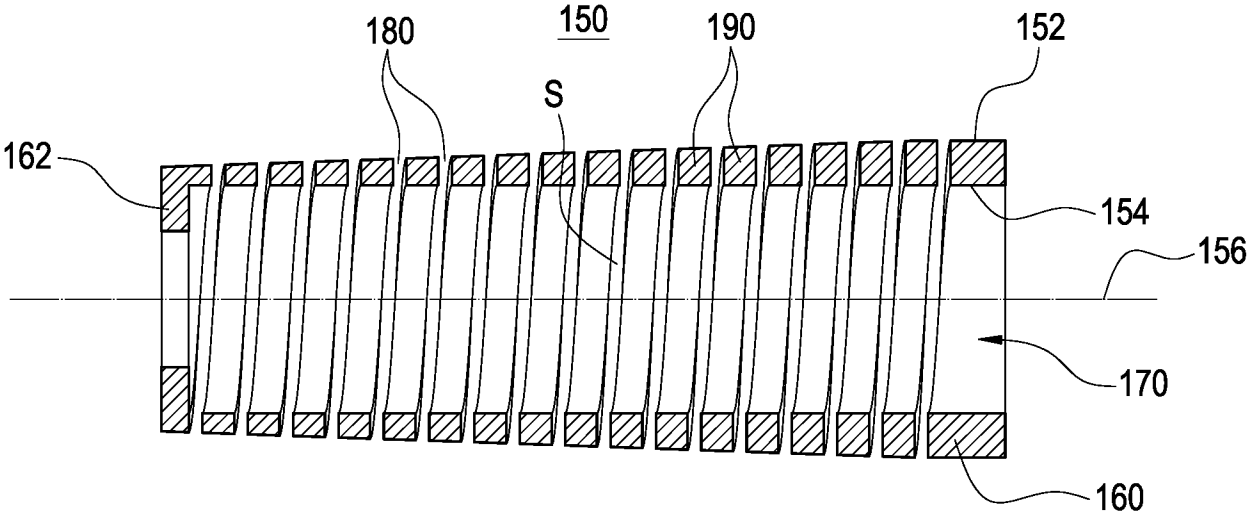
FIG. 3 is a cross-sectional view showing the resilient electrical conductor.
Figure 4:
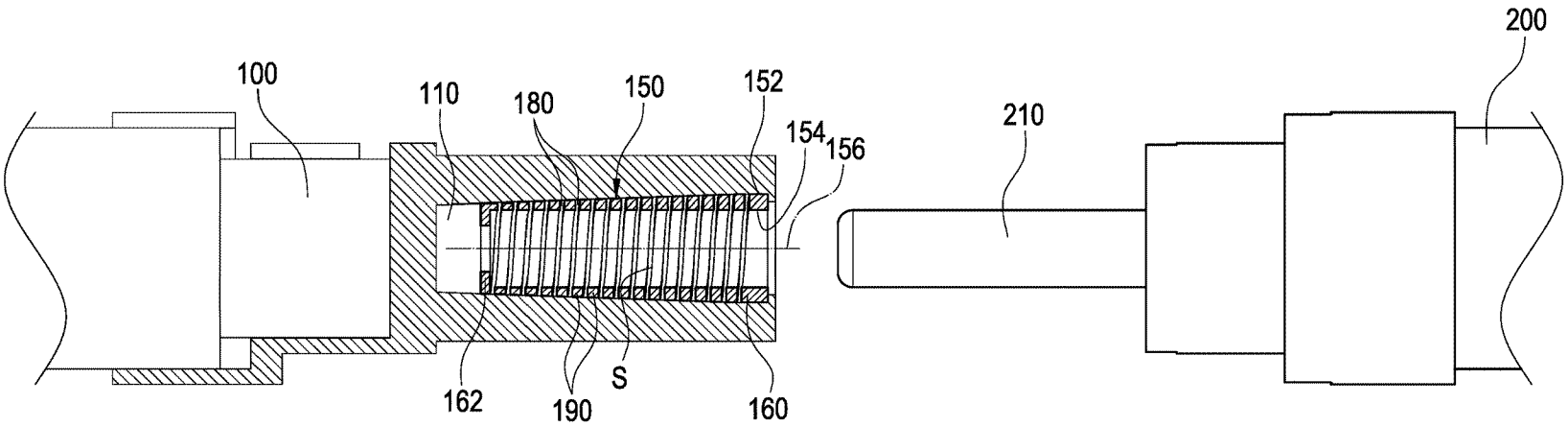
FIG. 4 is a partial cross-sectional view illustrating a non-connected state according to the first embodiment of the present invention.
Figure 10:
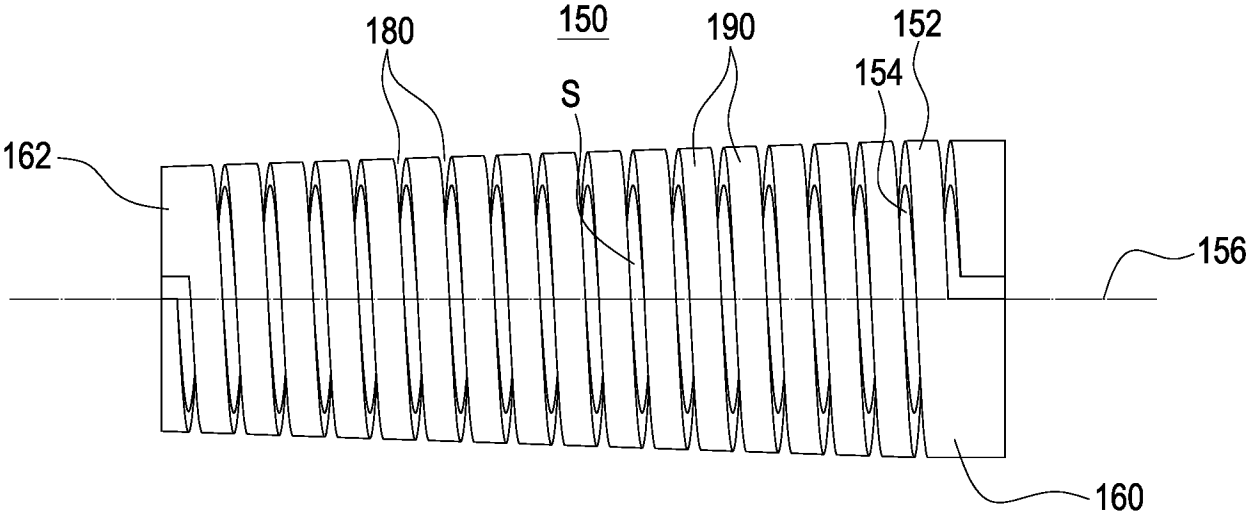
FIG. 10 is a schematic view illustrating the resilient electrical conductor according to the present invention.

Referring to FIGS. 2, 3 and 10, the insertion slot 110, the conductive element 210 and the resilient electrical conductor 150 consist of a conductive material like copper, iron or alloy thereof. The resilient body 160 further includes an outer circumferential surface 152, an inner circumferential surface 154 opposite to the outer circumferential surface 152, and an axis 156 coaxial with the outer circumferential surface 152 and the inner circumferential surface 154. In the present embodiment, the outer circumferential surface 152 is inclined with respect to the axis 156, and the inner circumferential surface 154 is parallel to the axis 156.

In other words, the insertion slot 110 of the first connector 100 is of conical shape, and the resilient electrical conductor 150 is of conical shape corresponding to the cone-shaped insertion slot 110. The insertion space 170 of the resilient electrical conductor 150 is of cylindrical shape, and the conductive element 210 is of cylindrical shape corresponding to the cylinder-shaped insertion space 170.

Figure 8:
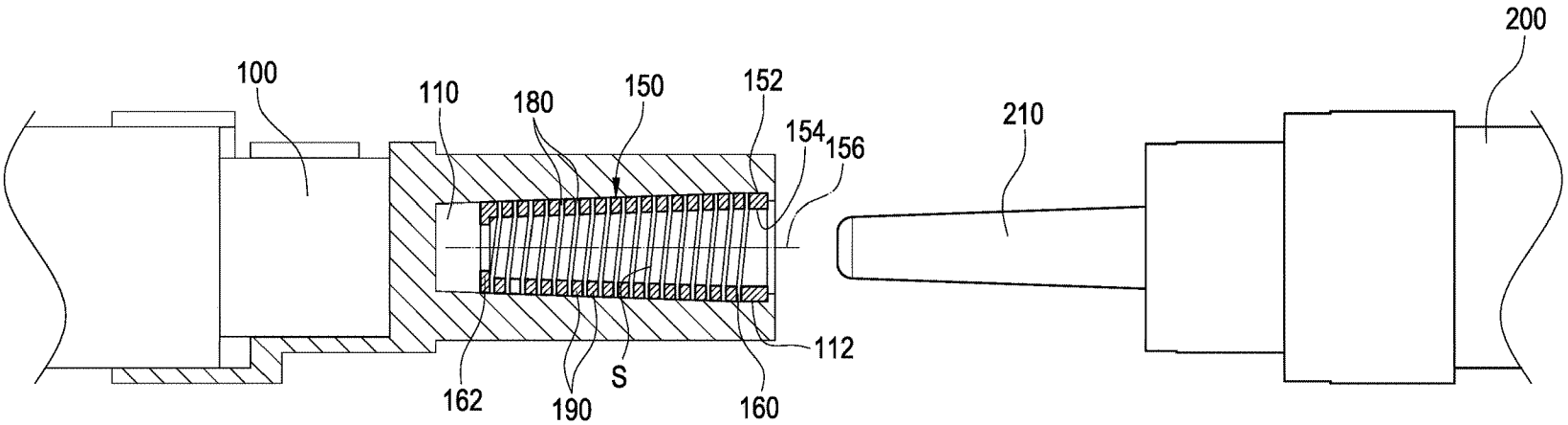
FIG. 8 is a partial cross-sectional view according to the third embodiment of the present invention.
Figure 9:
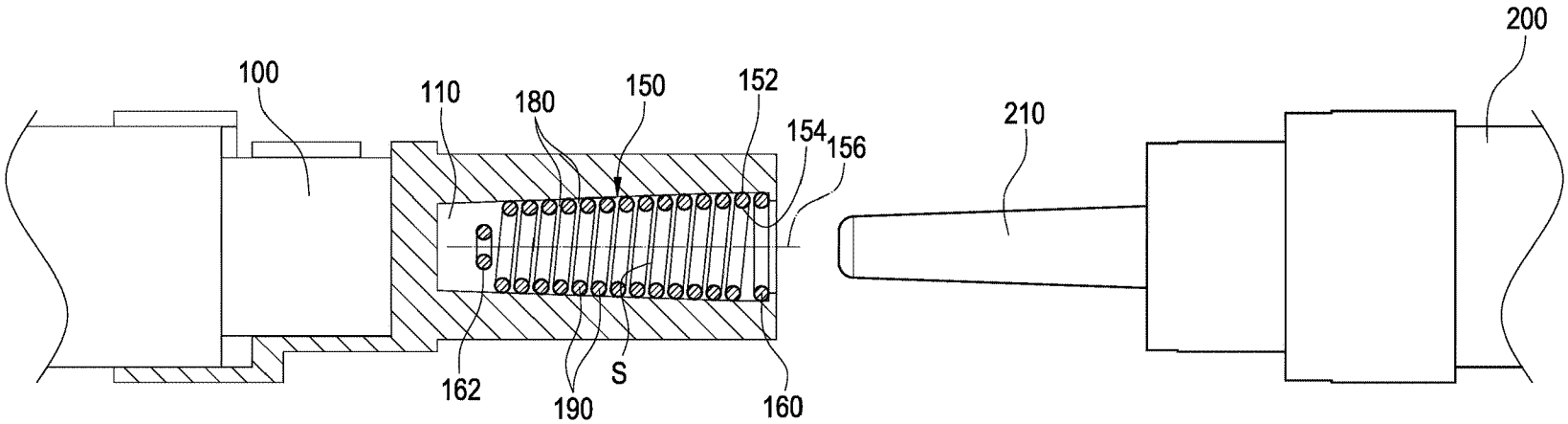
FIG. 9 is a partial cross-sectional view according to the fourth embodiment of the present invention.

In the embodiment shown in FIGS. 8 and 9, the inner circumferential surface 154 is inclined with respect to the axis 156, and the outer circumferential surface 152 is parallel to the axis 156. In other words, the insertion slot 110 of the first connector 100 is of cylindrical shape, and the resilient electrical conductor 150 is of cylindrical shape corresponding to the cylinder-shaped insertion slot 110. The insertion space 170 of the resilient electrical conductor 150 is of conical shape, and the conductive element 210 is of conical shape corresponding to the cone-shaped insertion space 170.

Each gap 180 preferably penetrates the outer circumferential surface 152 and the inner circumferential surface 154, and the gaps 180 are connected to form a spiral S, so that the resilient electrical conductor 150 can be a cylinder-shaped spiral spring, a cone-shaped spiral spring or other suitable spiral spring.

Figure 5:
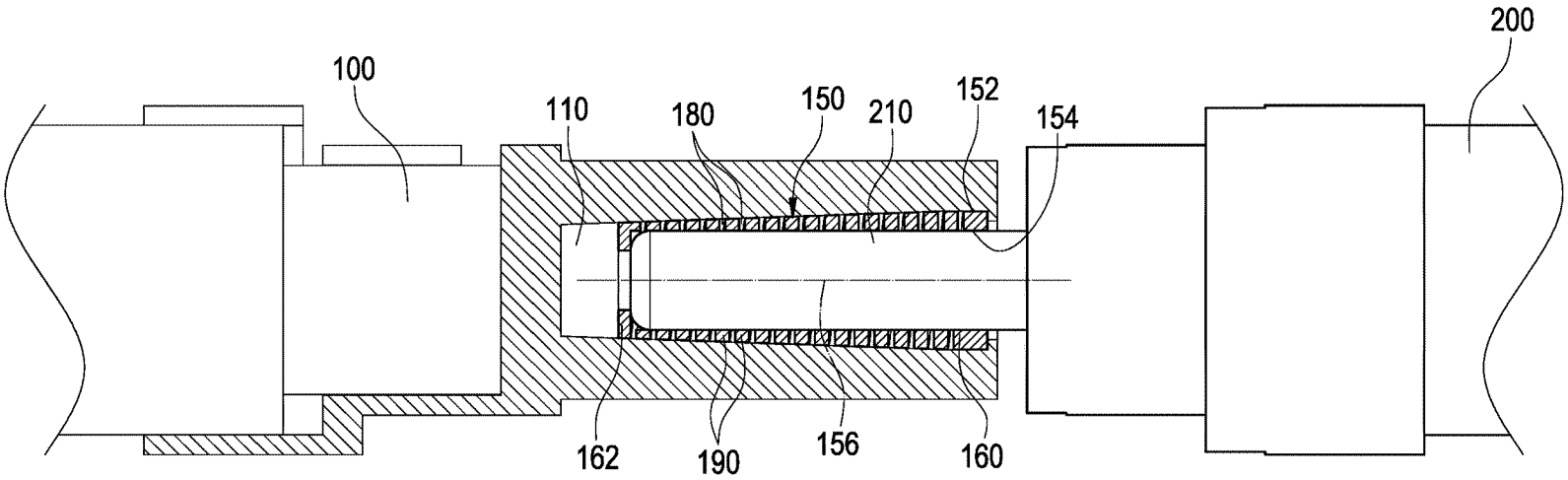
FIG. 5 is a cross-sectional view illustrating an act of insertion according to the first embodiment of the present invention.
Figure 6:
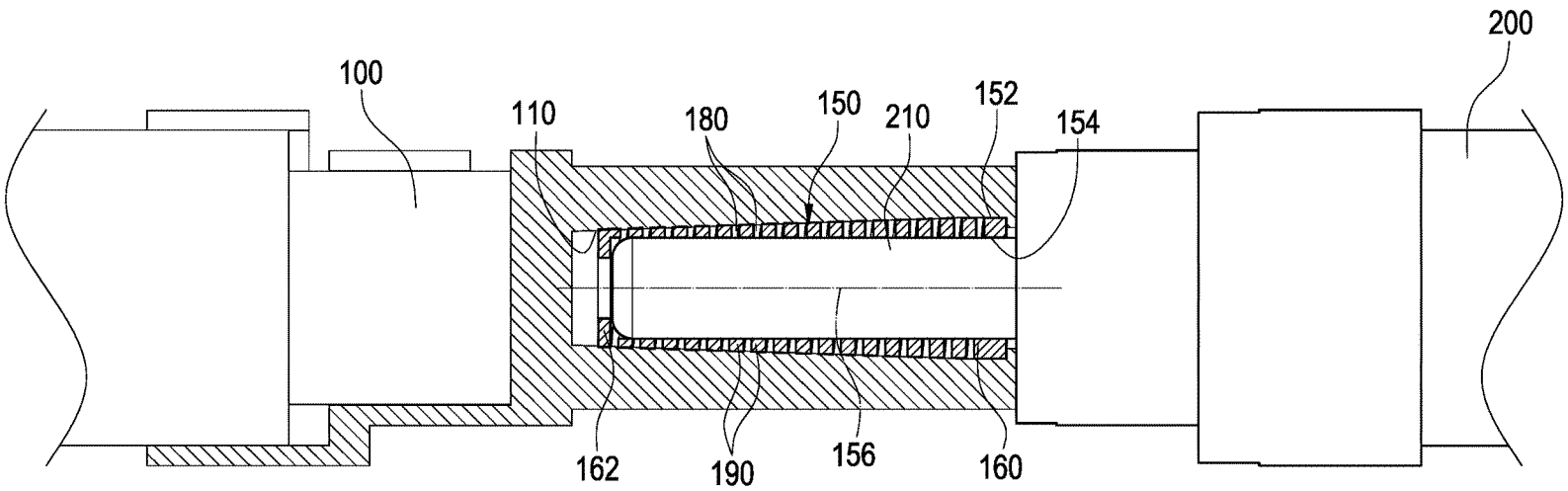
FIG. 6 is another cross-sectional view illustrating an act of insertion according to the first embodiment of the present invention.

Referring to FIGS. 5 and 6, when the resilient electrical conductor 150 is inserted into the insertion slot 110 of the first connector 100, the resilient electrical conductor 150 is shorter than the insertion slot 110. At this point, the outer circumferential surface 152 of the resilient electrical conductor 150 is in contact with a wall surface of the insertion slot 110, and the inner circumferential surface 154 is in contact with an annular surface of the conductive element 210. When the conductive element 210 of the second connector 200 is inserted into the insertion slot 110 of the first connector 100 and pushes a bottom of the resilient electrical conductor 150, each gap 180 becomes larger.

That is to say, according to the first embodiment, the cone-shaped resilient electrical conductor 150 is pushed by the conductive element 210 to stretch elastically, and as a result, each gap 180 becomes larger. Since the resilient electrical conductor 150 has elasticity and its shape corresponds to the insertion slot 110, the outer circumferential surface 152 closely contacts the wall surface of the insertion slot 110, and at the same time, the inner circumferential surface 154 also tightly binds the conductive element 210. This way, the present invention can achieve superior connection between the first conductor 100 and the second connector 200, and can thereby provide safe, reliable and stable connection quality.

Figure 7:
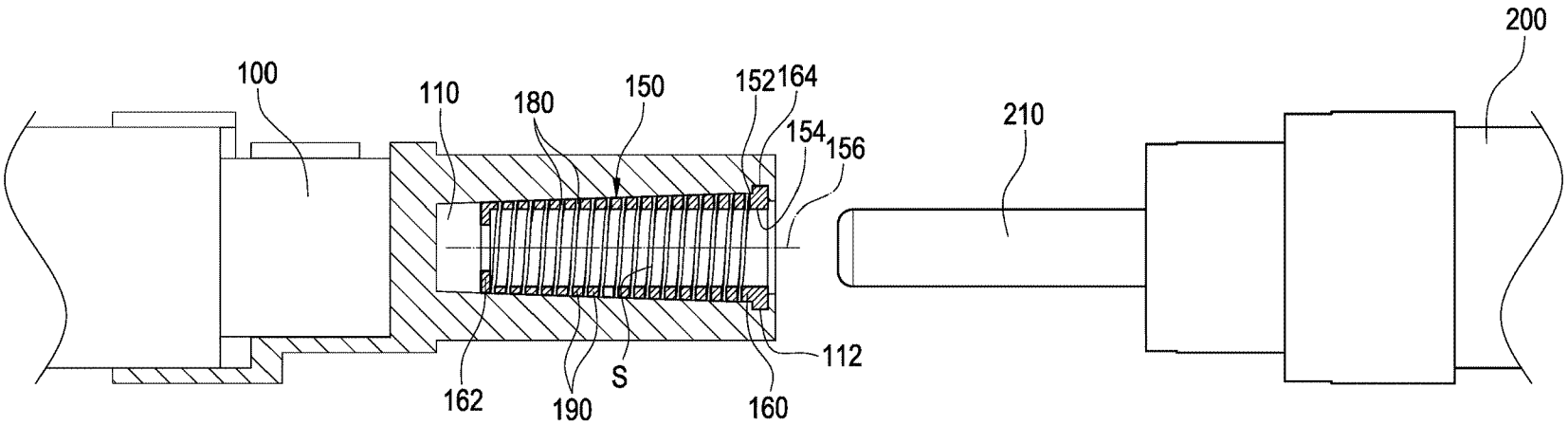
FIG. 7 is a partial cross-sectional view illustrating an act of insertion according to the second embodiment of the present invention.

Please refer to FIG. 7 illustrating a partial cross-sectional view according to the second embodiment of the present invention. In this embodiment, the resilient electrical conductor 150 further includes a closed end 162 at one end of the resilient body 160 and an engagement portion 164 on an outer edge of the other end of the resilient body 160 opposite to the closed end 162. The first connector 100 includes a recess 112 corresponding to the engagement portion 164, so that the resilient electrical conductor 150 is positioned in the insertion slot 110. As shown in FIG. 7, the engagement portion 164 is, for example, a flange, so one end of the resilient electrical conductor 150 can be positioned at a front edge of the insertion slot 110. As a result, when the conductive element 210 is inserted into the resilient electrical conductor 150, one end of the resilient body 160 is prevented from being pushed toward a bottom of the insertion slot 110 to compromise the binding effect that the resilient electrical conductor 150 binds the conductive element 210 and contacts the wall surface of the insertion slot 110.

Please refer to FIG. 8 illustrating a partial cross-sectional view according to the third embodiment of the present invention. This embodiment is different from the above-mentioned embodiment in that, the third embodiment has different configuration for tight binding effect. The insertion slot 110 of the first connector 100 is of cylindrical shape, and the resilient electrical conductor 150 is of cylindrical shape. The conductive element 210 is of conical shape, and the insertion space 170 is of conical shape. When the conductive element 210 is inserted into the insertion slot 110 of the resilient electrical conductor 150, the resilient body 160 stretches elastically upon being pushed by the conductive element 210. The cylinder-shaped conductive element 210 moves into the corresponding insertion space 170, so that the inner circumferential surface 154 of the resilient electrical conductor 150 tightly binds and contacts the conductive element 210, and the outer circumferential surface 152 also contacts the wall surface of the insertion slot 110.

Furthermore, the resilient electrical conductor 150 includes a contact portion 190 between each two adjacent gaps 180. In the first embodiment, it is preferable that a thickness of each contact portion 190 gradually decreases toward the bottom of the insertion slot 110. However, in the embodiment shown in FIG. 8, it is preferable that a thickness of each contact portion 190 gradually increases toward the bottom of the insertion slot 110, and a cross section of each contact portion 190 is preferably in a rectangular shape. However, in the embodiment shown in FIG. 9, a cross section of each contact portion 190 is preferably in a circular shape, and the shape of the cross section of each contact portion 190 may vary according to the type of the resilient body 160.

Referring to FIGS. 1 to 10, the present invention also provides a socket connector 100 for use with a plug connector 200 having a conductive element 210. The socket connector 100 includes an insertion slot 110 and a resilient electrical connector 150. The resilient electrical conductor 150 is accommodated in the insertion slot 110. The resilient electrical conductor 150 has a resilient body 160, an insertion space 170 inside the resilient body 160, and an axis 156 coaxial with the insertion slot 110 and the insertion space 170.

The resilient body 160 includes an outer circumferential surface 152 and an inner circumferential surface 154 opposite to the outer circumferential surface 152, and the outer circumferential surface 152 and the inner circumferential surface 154 are coaxial with the axis 156. The outer circumferential surface 152 or the inner circumferential surface 154 is inclined with respect to the axis 156. In the embodiment shown in FIGS. 4 to 7, the insertion slot 110 is of conical shape, the outer circumferential surface 152 of the resilient electrical conductor 150 forms a conical shape corresponding to the cone-shaped insertion slot 110, and the insertion space 170 is of cylindrical shape to facilitate insertion of the cylinder-shaped conductive element 210. However, in the embodiment shown in FIGS. 8 and 9, the insertion slot 110 is of cylindrical shape, the outer circumferential surface 152 of the resilient electrical conductor 150 is of cylindrical shape corresponding to the cylinder-shaped insertion slot 110, and the insertion space 170 is of conical shape to facilitate insertion of the cone-shaped conductive element 210.

Other details regarding to the structure of the socket connector 100 and the connection between the socket connector 100 and the plug connector 200 are described in the above-mentioned embodiment, so a detail description is omitted herein for brevity.

It is to be understood that the above descriptions are merely the preferable embodiments of the present invention and are not intended to limit the scope of the present invention. Equivalent changes and modifications made in the spirit of the present invention are regarded as falling within the scope of the present invention.

What is claimed is:

1. A high current connector, comprising:

a first connector including an insertion slot;

a resilient electrical conductor accommodated in the insertion slot, the resilient electrical conductor including a resilient body and an insertion space formed inside the resilient body, the resilient body including an outer circumferential surface, an inner circumferential surface opposite to the outer circumferential surface, and an axis coaxial with the outer circumferential surface and the inner circumferential surface, wherein the outer circumferential surface or the inner circumferential surface is inclined with respect to the axis; and a second connector including a conductive element inserted in the insertion space, the conductive element being electrically connected to the first connector through the resilient electrical conductor and being fixed in the insertion slot, wherein the resilient body is a spiral spring, and a thickness of each coil of the spiral spring along a radial direction of each coil increases or decreases along an axial direction of the spiral spring, and wherein the outer circumferential surface and the inner circumferential surface of the spiral spring fully contact an inner surface of the insertion slot and a whole outer surface of the conductive element, respectively.

2. The high current connector according to claim 1, further comprising a plurality of gaps arranged annularly on the resilient body, each gap penetrating the outer circumferential surface and the inner circumferential surface, the gaps being connected to form a spiral.

3. The high current connector according to claim 1, wherein a cross section of each coil is in a rectangular shape or in a circular shape.

4. The high current connector according to claim 1, wherein the insertion slot is of conical shape, and the resilient electrical conductor is of conical shape corresponding to the cone-shaped insertion slot.

5. The high current connector according to claim 4, wherein the insertion space is of cylindrical shape, and the conductive element is of cylindrical shape corresponding to the cylinder-shaped insertion space.

6. The high current connector according to claim 1, wherein the insertion slot is of cylindrical shape, and the resilient electrical conductor is of cylindrical shape corresponding to the cylinder-shaped insertion slot.

7. The high current connector according to claim 6, wherein the insertion space is of conical shape, and the conductive element is of conical shape corresponding to the cone-shaped insertion space.

8. The high current connector according to claim 1, wherein the resilient electrical conductor further includes a closed end at one end of the resilient body and an engagement portion on an outer edge of the other end of the resilient body opposite to the closed end.

9. The high current connector according to claim 8, wherein the first connector includes a recess corresponding to the engagement portion, so that the resilient electrical conductor is positioned in the insertion slot.

10. A socket connector, comprising:

an insertion slot; and a resilient electrical conductor accommodated inside the insertion slot, the resilient electrical conductor including a resilient body, an insertion space inside the resilient body, and an axis of the insertion slot coaxial with the insertion space, wherein the resilient body includes an outer circumferential surface and an inner circumferential surface opposite to the outer circumferential surface, the outer circumferential surface and the inner circumferential surface are coaxial with the axis, and the outer circumferential surface or the inner circumferential surface is inclined with respect to the axis;

wherein the resilient body is a spiral spring, and a thickness of each coil of the spiral spring along a radial direction of each coil increases or decreases along an axial direction of the spiral spring, and wherein the outer circumferential surface of the spiral spring fully contacts an inner surface of the insertion slot.

11. The socket connector according to claim 10, wherein the insertion slot is of conical shape, the resilient electrical conductor is of conical shape corresponding to the cone-shaped insertion slot, and the insertion space is of cylindrical shape.

12. The socket connector according to claim 10, wherein the insertion slot is of cylindrical shape, the resilient electrical conductor is of cylindrical shape corresponding to the cylinder-shaped insertion slot, and the insertion space is of conical shape.

* * * * *